US009789019B2

(12) United States Patent
DuFresne

(10) Patent No.: US 9,789,019 B2
(45) Date of Patent: Oct. 17, 2017

(54) ADJUSTABLE BACKREST

(71) Applicant: The Comfort Companies, Inc., Bozeman, MT (US)

(72) Inventor: Steven DuFresne, Hartland, WI (US)

(73) Assignee: The Comfort Companies, Inc., Bozeman, MT (US)

( * ) Notice: Subject to any disclaimer, the term of this patent is extended or adjusted under 35 U.S.C. 154(b) by 0 days.

(21) Appl. No.: 15/377,462

(22) Filed: Dec. 13, 2016

(65) Prior Publication Data

US 2017/0087038 A1 Mar. 30, 2017

Related U.S. Application Data

(63) Continuation of application No. 14/629,202, filed on Feb. 23, 2015, now abandoned.

(60) Provisional application No. 61/977,498, filed on Apr. 9, 2014.

(51) Int. Cl.

| | |
|---|---|
| ***A61G 5/10*** | (2006.01) |
| ***A47C 7/32*** | (2006.01) |
| ***A47C 7/46*** | (2006.01) |
| ***A61G 5/12*** | (2006.01) |

(52) U.S. Cl.

CPC ..... *A61G 5/122* (2016.11); *A47C 7/32* (2013.01); *A47C 7/465* (2013.01); *A61G 5/1067* (2013.01); *A61G 5/1091* (2016.11); *A61G 2200/20* (2013.01)

(58) Field of Classification Search

CPC ..... B60N 2/4415; B60N 2/66; A47C 5/06; A47C 7/28; A47C 7/282; A47C 7/32; A47C 7/465; A61G 2005/1091; A61G 5/12; A61G 5/1067; A61G 2005/122; A61G 2200/20; A61G 5/122; A61G 5/1091

USPC ..... 297/284.2, 218.1, DIG. 6, 204, 452.63, 297/452.64, 284.1; 24/19, 32

See application file for complete search history.

(56) References Cited

U.S. PATENT DOCUMENTS

| | | | | |
|---|---|---|---|---|
| 7,467,426 | B1 * | 12/2008 | Jarmon | A47C 23/18 5/191 |
| 2009/0115234 | A1 * | 5/2009 | Samain | B60N 2/0232 297/284.2 |
| 2013/0334787 | A1 * | 12/2013 | Gosseen | B62J 1/10 280/200 |
| 2015/0223608 | A1 * | 8/2015 | Capra | A47C 7/22 297/452.18 |

* cited by examiner

*Primary Examiner* — Milton Nelson, Jr.
(74) *Attorney, Agent, or Firm* — Michael Best & Friedrich LLP

(57) ABSTRACT

The disclosed adjustable backrest provides a plurality of generally horizontal straps arranged from the top to the bottom of the rigid back shell to provide anterior to posterior support and comfort for a patient. Generally speaking, the generally horizontal straps provide variably adjustable tension straps that allow for precise positioning of the patient to reduce or remove pressure points from the patient's thoracic to sacrum region.

11 Claims, 5 Drawing Sheets

ADJUSTABLE BACKREST

CROSS-REFERENCE TO RELATED APPLICATIONS

This application is a continuation application of U.S. patent application Ser. No. 14/629,202, filed on Feb. 23, 2015, and entitled Adjustable Backrest (as amended), which claims priority to U.S. Provisional Patent Application No. 61/977,498, filed on Apr. 9, 2014, and entitled Backrest, the entire contents of these applications is hereby incorporated by reference in its entirety.

FIELD OF THE INVENTION

The disclosure herein relates generally to an improved backrest designed to safely position and accommodate spinal deformities presented throughout the wheelchair user population. More specifically, the disclosure relates to a new backrest that safely positions and accommodates most known spinal deformities through a range of anterior to posterior adjustments made within the system itself.

BACKGROUND OF THE INVENTION

Seating and positioning technologies are primarily directed to four main areas of concern, namely, posture, skin integrity, function and patient comfort. Posture generally refers to the support and accommodation of various spinal deformities such as kyphosis, lordosis and scoliosis. Kyphosis is an exaggeration of the curving of the spine that causes a bowing or rounding of the back, which leads to a hunchback or slouching posture. Lordosis refers to an exaggeration of the inward curve of the lumbar spine. Other postural defects observed in the patient population include but are not limited to the loss of normal lumbar curve, rounded shoulders, thoracic kyphosis and lower cervical fluxion with upper cervical extension.

Skin integrity is another important concern. Individuals Who spend a significant amount of time in wheelchairs can develop skin conditions caused by pressure or shear between the skin and the point of contact to the wheelchair.

Function relates to the mobility and motion provided to the wheelchair user using the various seating and positioning products. The industry classifies this patient capability through the definition of Activities of Daily Living (ADL). ADL is a term used in healthcare to describe routine activities that people tend do every day without needing assistance. There are some basic ADLs which include: eating, dressing, mobility and toileting. The claimed backrest helps promote these necessary functions through proper support and uniform pressure over the given area while avoiding limitations to a user's range of motion to perform these ADLs.

Finally, patient comfort is of utmost concern for individuals who must use a wheelchair for long periods of time. The claimed invention provides several areas of adjustability as well as a wide range of adjustability within a given area of the backrest. The claimed invention is designed to be able to accommodate all of the above-mentioned seating and positioning needs thereby increasing users' overall mobility and lessening users' potential for injuries.

SUMMARY OF THE INVENTION

The claimed invention provides a backrest with a reinforced frame such that a large center portion of the chair back is open so as to allow for spinal deformities to protrude through the aperture. The claimed invention provides for various adjustable tensioning mechanisms to support certain spinal deformities. Although variable for specific conditions, the claimed invention provides an aperture that begins approximately above the posterior superior iliac spine of a patient and may, at its highest point, be no higher than their acromion process.

The claimed invention permits anterior and posterior adjustments in the backrest to reduce the pressure over a given area. The claimed invention further permits its main support surface, the backrest, to be infinitely variable to the patients complementing support needs within its field of adjustment. The claimed inventions ability to compliment and support the varying patient shapes is what increases the patient contact area thus lowering the overall pressure applied per square inch. This reduction in pressure per square inch to the patients skin directly decreases the risk for skin tissue breakdown.

The invention further provides a plurality of generally horizontal straps arranged from the top to the bottom of the rigid back shell to provide additional anterior to posterior support and comfort for a patient. It would be additionally desirable to provide variably adjustable and horizontally mounted tension adjustable straps that would allow for precise positioning of the patient to reduce or remove pressure points from the patient's thoracic to sacrum region. It would be further advantageous to provide a design wherein it is possible to adjust the tension of the strap while the patient full weight is seated against the backrest.

The claimed invention is extremely useful in treating conditions such as lordosis, kyphosis and scoliosis because of its flexibility of use in the coronal and sagittal planes, although it can be used to treat other conditions. For example, the claimed inventions is very well suited to provide support to a person with Lordosis because it allows protrusion of the upper thoracic region through the shell of the backrest in the sagittal plane. The adjustable tension mechanism of the claimed invention allows the back to maintain uniform support across the back of the user to support the lordosis without creating pressure spots. Likewise, the claimed is also useful in treating defects in the coronal-sagittal plane such as scoliosis. Scoliotic patients frequently require some corrective pressure to one side or another of the spine. The adjustable tension mechanism of the claimed invention allows a section of the backrest to be set to a specific corrective pressure to support scoliotic protrusions.

Of course, it would be advantageous to provide a backrest in a variety of widths and heights to fit people of all shapes and sizes. It would be further advantageous to provide a backrest that can be used with lateral pads to both position a user and to support the user. It would also be advantageous to provide a backrest that can be used with existing single point and multipoint mounting systems and with all types of existing wheelchairs.

DETAILED DESCRIPTION

Figure 1:
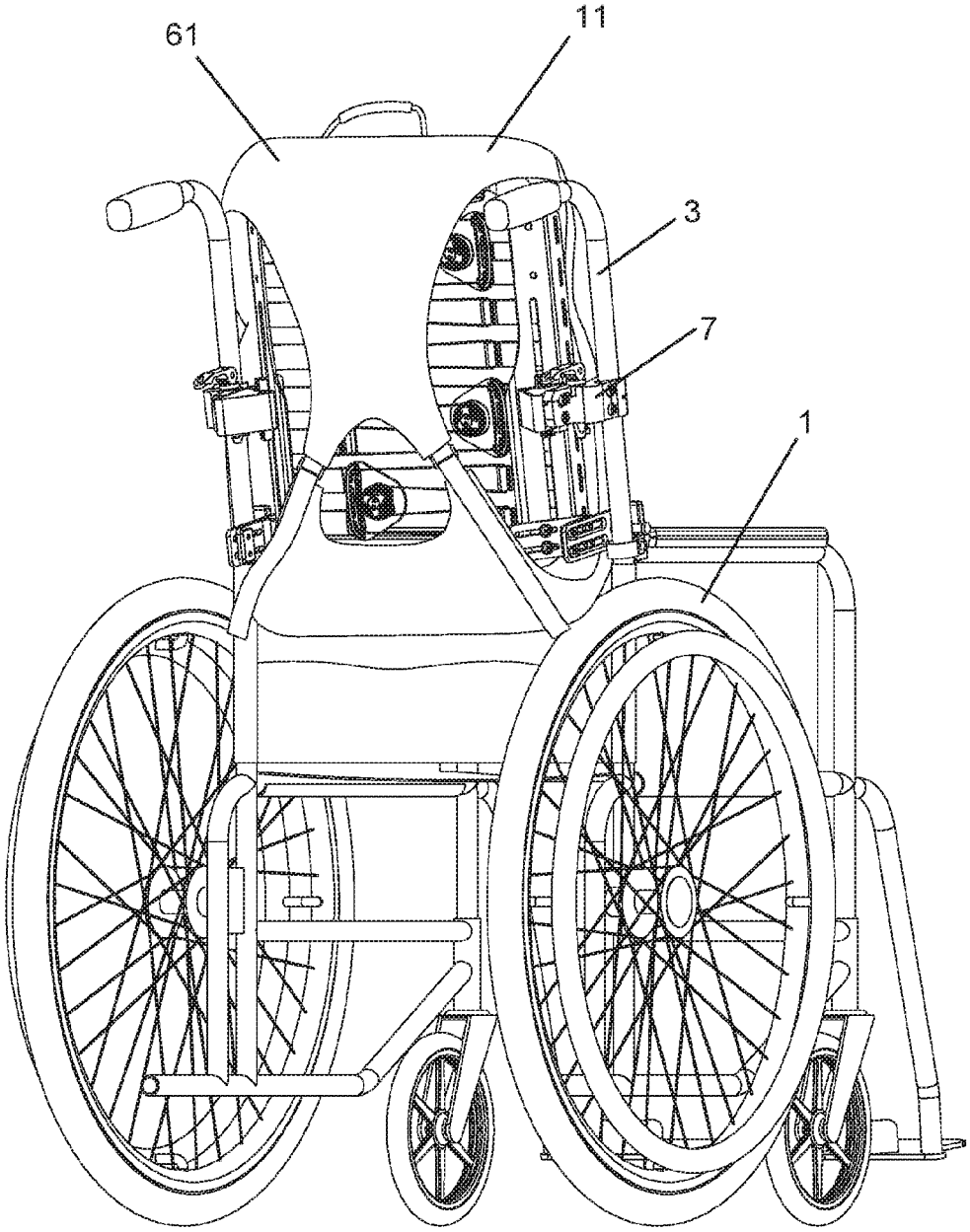
FIG. 1 shows a side and rear perspective view of the claimed backrest with a cover installed over the claimed backrest, the backrest being installed on a wheelchair.
Figure 3:
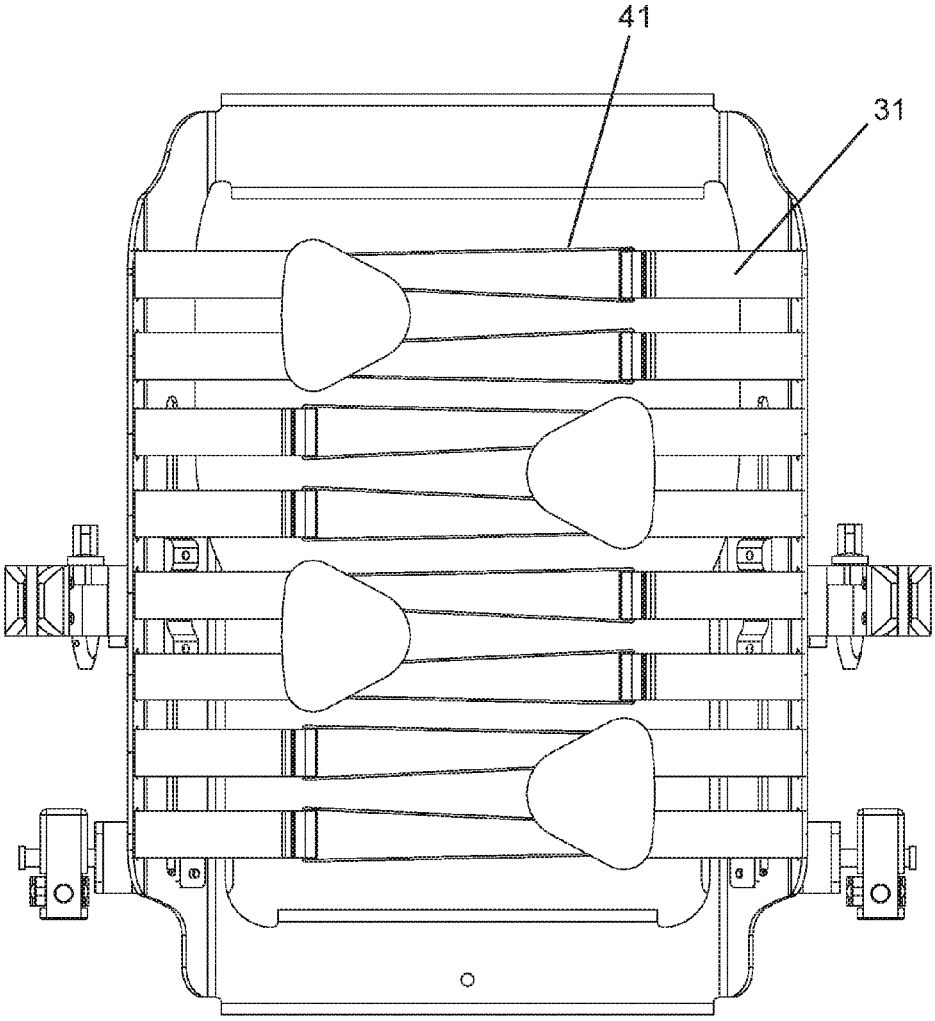
FIG. 3 shows a front elevational view of the claimed backrest with the backrest cover removed.
Figure 4:
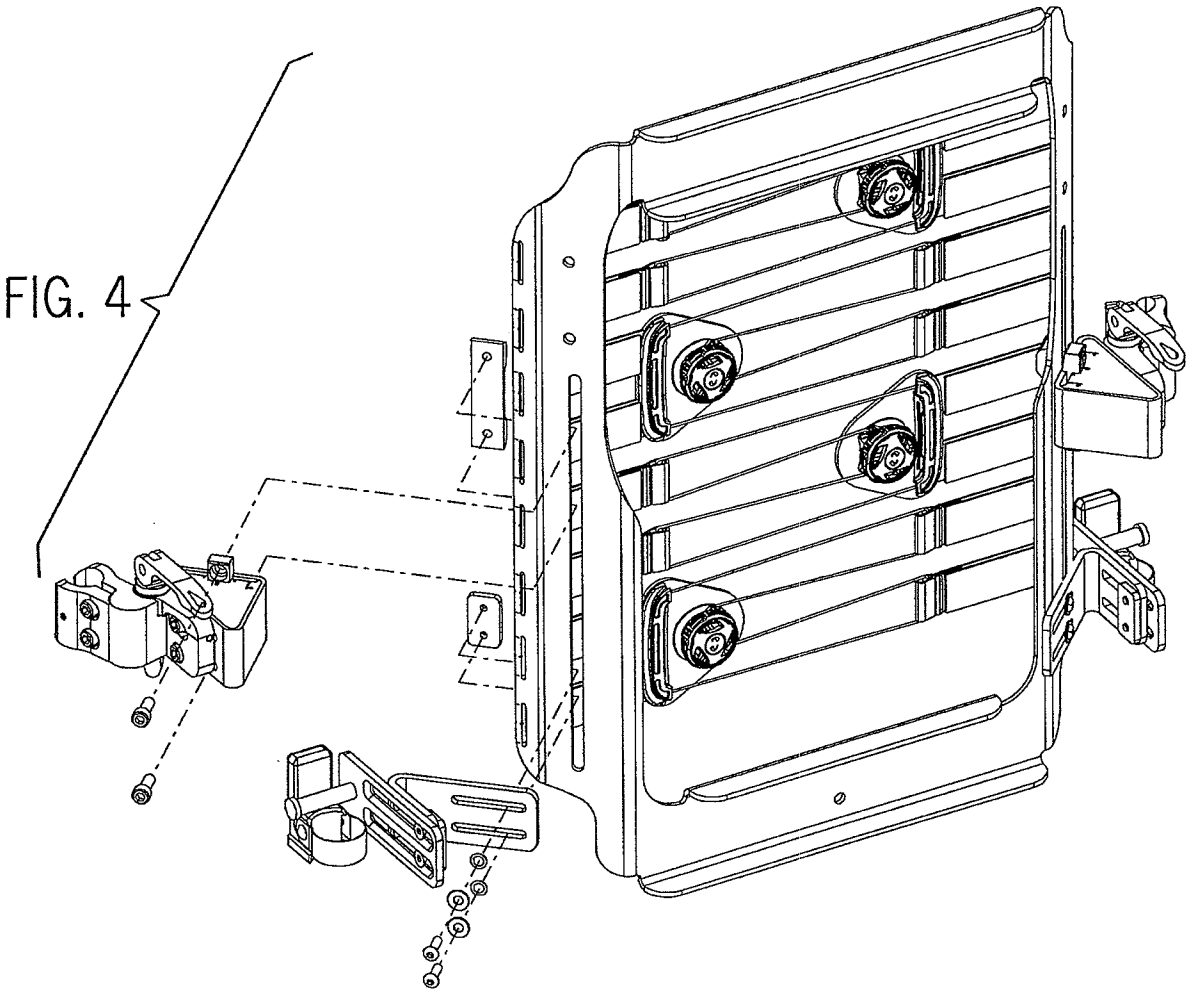
FIG. 4 shows a side and back exploded perspective view of one type of installation bracket that can be used with the claimed backrest.

Now, referring to the drawings in detail, wherein like reference numbers refer to like elements throughout, FIG. 1 shows the claimed backrest 11 installed on the upright supports or canes 3 of a wheelchair 1. The backrest 11 can be installed on the canes 3 of a wheelchair using any of a plurality of conventional wheelchair back mounting brackets 7, such as the two point mounting bracket system shown in FIG. 1. The backrest 11 can also be installed using a single point mounting system as shown in FIG. 3.

Figure 2:
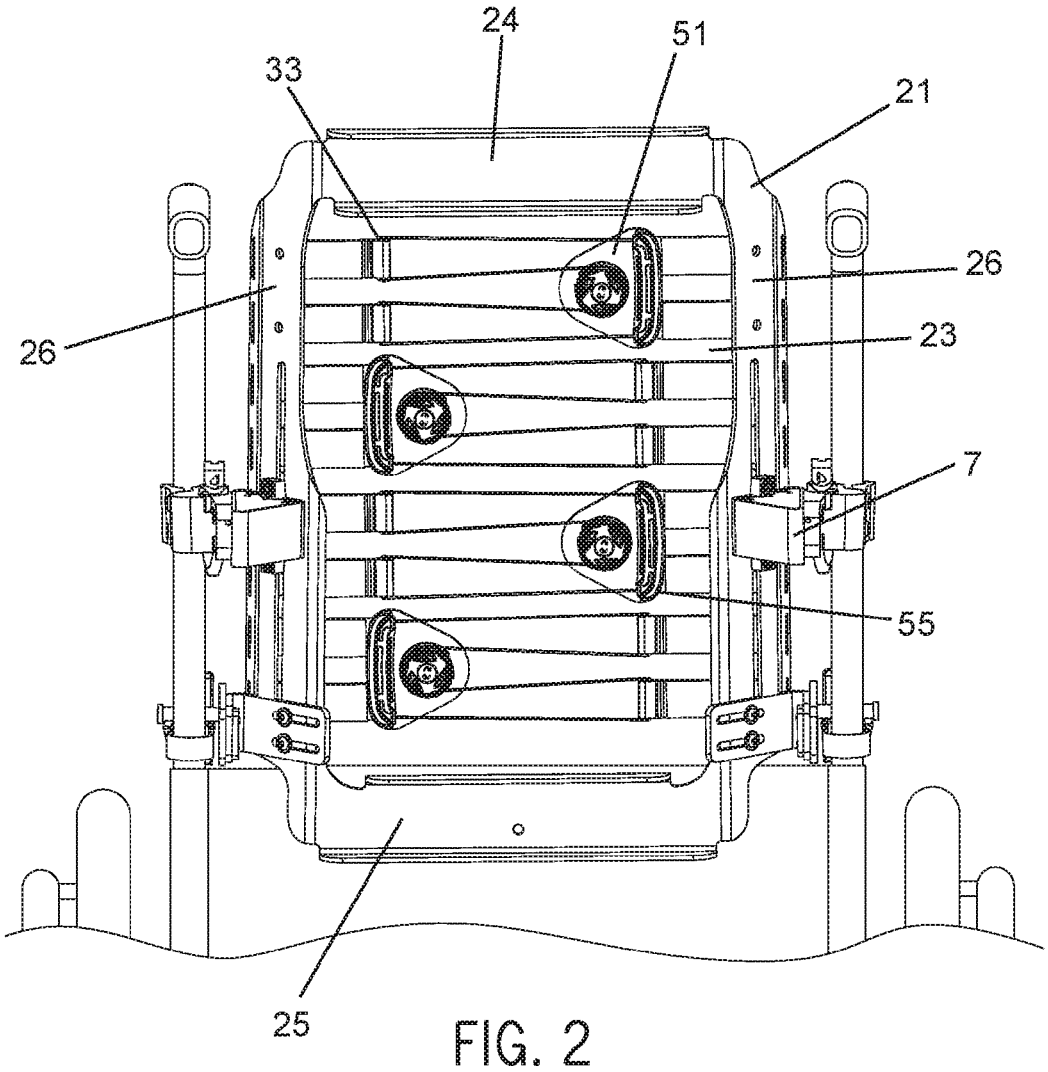
FIG. 2 shows a rear devotional view of the claimed backrest without a backrest cover attached to the canes of a wheelchair showing one type of tension adjustment mechanism.

Referring now to FIG. 2, the backrest 11 is comprised of a rigid perimeter frame 21 having a large central aperture 23, a top portion 24, a bottom portion 25 and a pair of substantially identical sides 26. Sides 26 provide attachment means for a plurality of fixed straps 31, which extend from both sides 26 of the backrest 11. Possible attachment means for the plurality of fixed straps 31 include apertures, grommets and hooks as well as other fixed and removable attachment means. Fixed straps 31, in at least one embodiment, serve as attachment points for variably adjustable tension straps 41, but are not necessary to the claimed invention. Variably adjustable tension straps 41 are arranged between the fixed straps 26.

The claimed invention could include several variably adjustable straps 41. For example, in the embodiment shown in FIG. 3, four variably adjustable straps 41 are used. Thus, the embodiment shown can provide adjustment in four areas along the vertical aspect of the backrest. Alternate embodiments using either more or fewer variably adjustable straps 41 are within the scope of the invention in that certain condition might require either more adjustability or less adjustability.

Variably adjustable straps 41 can preferably be tensioned and eased without moving the person seated against the backrest 11 via tensioning mechanism 51. One embodiment of the invention calls for variably adjustable straps 41 that can be an inelastic cord or cable that is securable at a tension but can be further tensioned or eased off, if necessary. An additional embodiment could employ hook and loop style fasteners that can be pulled through a loop or buckle, doubled back over and secured to itself. Likewise, other tensioning mechanisms 51 could be used including, but not limited to ratchet tensioners, reel tensioners, screw tensioners, cable tensioners and spring tensioners, all of said tensioning mechanism being designed maintain a desired fit to the backrest, allow easy adjustment, be adjustable in small increments, have a high degree stability once adjusted and be at least somewhat resistant to moisture and other elements.

Referring again to the particular embodiment of the invention shown in FIG. 3, which shows four separately adjustable support structures 45, each of said adjustable support structures 45 having an adjustable tensioning mechanism 51 to control one section of the backrest 11. Obviously, more or fewer support structures 45 could be used. Moreover, as shown on FIG. 3, there are eight fixed straps 31 on each side 26 of the backrest 11. It is possible to employ more fixed straps 31 and additional adjustable tension mechanisms 51 so as to add adjustable support structures 45 which are each individually adjustable to the backrest 11.

In the claimed embodiment shown in FIG. 3, each of the adjustable tension mechanisms 51 is attached to two fixed straps 31. Cable 41 is wound through loop buckles 33, or 81 (shown in FIG. 5), or around guide members or the like which are attached to fixed straps 31 opposite the adjustable tension mechanisms 51. It is preferable to provide guide members or loop buckles 33, 81 or the like that offer relatively little friction to cable 41 so that cable 41 tension remains uniform throughout the length of the cable 41. It is even more preferable to provide low friction guide members 33. Additionally, adjustable tension mechanism 51 could be attached to only a single fixed strap 31. Thus, in the embodiment shown, each pair of fixed straps 31 would be connected by a cable 41 tensioned by an adjustable tension mechanism 51. Likewise, the cable 41 of the claimed invention is not limited to standard round cross-section cable, but could include flat straps and other types of connecting means.

In an additional embodiment, the fixed straps 31 are not used and the adjustable tension mechanism 51 is attached to one side 26 of the backrest 11 and cable 41 is attached to the opposite side of the backrest 11 via low friction guide members 33. As in the case of the embodiment using the fixed straps 31, it is possible to use as many or as few adjustable tension mechanisms 51 as is desired.

As shown in FIG. 3, adjustable tension member 51 may further include a guide member 55. Guide member 55 essentially provides a path for cable 41 such that cable 41 can be doubled over so as to serve a broader area of the backrest 11 as shown in FIG. 3. Thus, cable guide member 55 is helpful to create a larger section under the control of a single adjustable tension member 51.

For example, as shown in FIG. 2, adjustable tension member 51 is attached to one side of the rigid backrest frame 21 by fixed straps 31. Opposite the adjustable tension member 51 are a pair of guide members 33. As shown in FIG. 2, the cable runs from the adjustable tension mechanism to the first guide member 33 attached to the first side of the rigid backrest frame 21, around the cable guide 55 on the adjustable tension member 51 and then around the second guide member 33 attached to the first side of the frame and then back to the adjustable tension mechanism.

Preferably, and as shown in FIG. 1, the front of the backrest 11 is covered by a cover 61 that may or may not include additional cushioning. Additional lateral supports (not shown) attachable to the backrest for further positioning needs.

Figure 5:
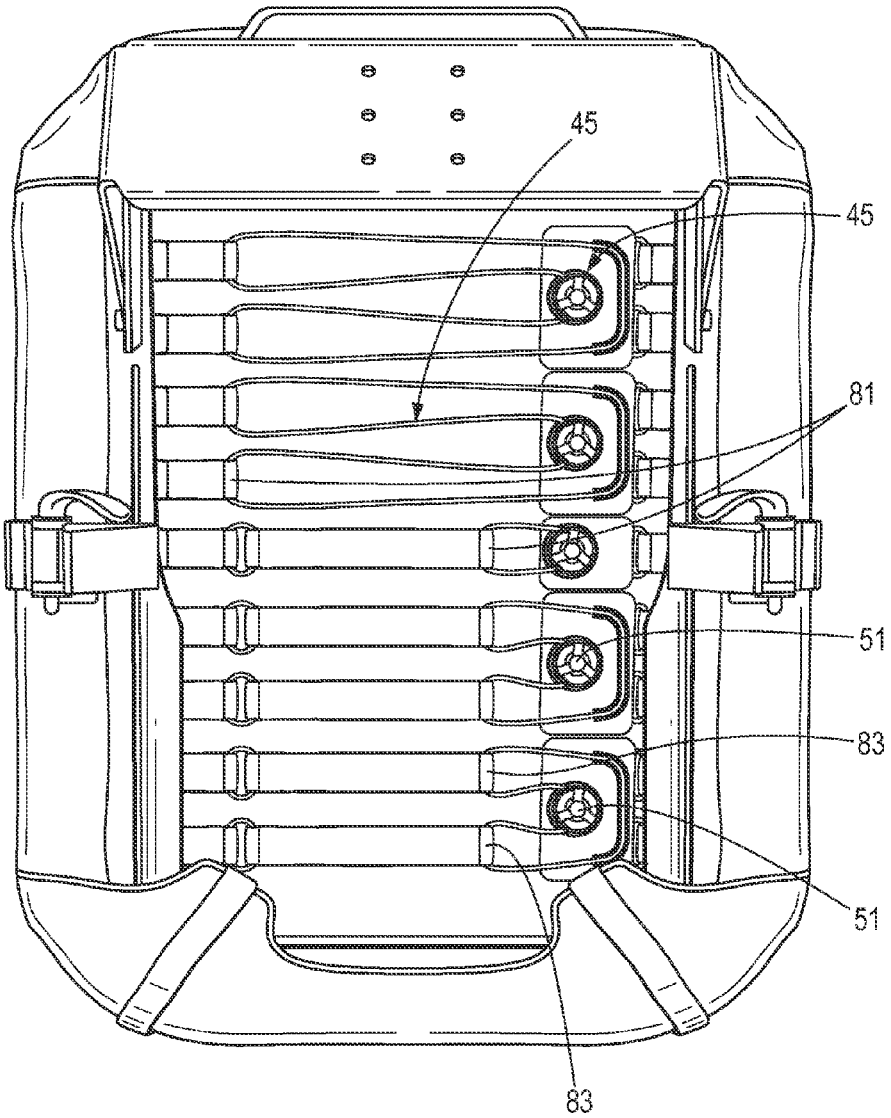
FIG. 5 is a rear elevational view of the backrest showing two alternative configurations of the backrest.

FIG. 5 shows two additional embodiments of the claimed invention. Specifically, FIG. 5 shows five (5) adjustable support structures 45. The upper two (2) adjustable support structures 45 are identical to those disclosed elsewhere in this detailed description. The lower two (2) support structures 45, while similar in function, are slightly different in appearance. Specifically, instead of a cable 41 that stretches across the backrest 11 to the opposite side of the backrest, flat straps 83 are tensioned across backrest using an adjustable tension member 51.

The middle adjustable support structure 45 shown in FIG. 5 is a single strap 83 support structure. Instead of using the single strap 83 as shown, the adjustable support structure 45 might also employ a cable 41 that stretches across the backrest as shown in the above embodiments.

As discussed above, the claimed invention is particularly well-suited for patients with lordosis and scoliosis in that it is adjustable along the height of the backrest to provide uniform corrective pressure to aid in treating postural defects and deformities.

While the present invention has been described in terms of preferred embodiments, it is recognized that equivalents, alternatives, and modifications, aside from those expressly stated, are possible and within the scope of the appending claims.

What is claimed is:

1. A backrest for use with a chair, the backrest comprising:

a rigid frame comprising a first side spaced a distance from a second side;

a first guide member coupled to the first side;

a second guide member coupled to the first side; and a support structure comprising:

a cable having a first end and a second end, the first and second ends removably secured to an adjustable tension mechanism;

the adjustable tension mechanism operable to adjust a tension of the cable and to secure the cable at a given length, wherein the adjustable tension mechanism further comprises a cable guide member, wherein the cable extends from the adjustable tension mechanism to slidably engage the first guide member, then from the first guide member around a portion of the cable guide member, then from the cable guide member to slidably engage the second guide member, and then from the second guide member back to the adjustable tension mechanism.

2. The backrest of claim 1 wherein the first guide member further comprises a first buckle loop attached to the first side of the rigid frame and wherein the cable goes through the first buckle loop.

3. The backrest of claim 1 wherein the adjustable tension mechanism is attached to the second side of the rigid frame.

4. The backrest of claim 1 wherein the first guide member, the second guide member, and the cable guide member each have a low friction surface along which the cable is configured to slide.

5. The backrest of claim 1 further compromising a cover that fits over at least a portion of the backrest.

6. The backrest of claim 1 further comprising at least one additional support structure.

7. A support assembly and a backrest comprising:

the backrest comprising a rigid frame including a first side and a second side; and the support assembly comprising:

a first guide member attached to the first side of the rigid frame;

a second guide member attached to the first side of the rigid frame;

a cable having a first end and a second end; and an adjustable tension mechanism attached to the second side of the rigid frame, the adjustable tension mechanism further comprising a cable guide member and wherein the cable runs from the adjustable tension mechanism to the first guide member attached to the first side of the rigid frame, around the cable guide member, around the second guide member and then back to the adjustable tension mechanism, the adjustable tension mechanism being operable to adjust a length of an unwound portion of the cable.

8. The backrest of claim 7 comprising a plurality of support assemblies.

9. The backrest of claim 7 wherein the rigid frame has a large central aperture.

10. The backrest of claim 7 further compromising a cover that fits over the backrest or a portion thereof.

11. The backrest of claim 7 wherein the adjustable tension mechanism is a ratchet tensioner.

* * * * *